United States Patent [19]

Keller et al.

[11] Patent Number: 4,510,647

[45] Date of Patent: Apr. 16, 1985

[54] METHOD AND APPARATUS FOR CONTROLLING FIBER DENSITY

[76] Inventors: Alex J. Keller, 75 Ridgeport Rd., Clover, S.C. 29710; Akiva Pinto, 525 Eastwood Dr., Gastonia, N.C. 28052

[21] Appl. No.: 434,009

[22] Filed: Oct. 13, 1982

[51] Int. Cl.[3] ..... D01G 15/40

[52] U.S. Cl. ..... 19/105; 19/240; 19/300

[58] Field of Search ..... 19/105, 240, 300

[56] References Cited

U.S. PATENT DOCUMENTS

| | | | |
|---|---|---|---|
| 4,030,635 | 6/1977 | Hablützel | 19/105 X |
| 4,161,052 | 7/1979 | Erben | 19/240 |
| 4,184,361 | 1/1980 | Erben | 19/240 X |
| 4,199,843 | 4/1980 | Leifeld et al. | 19/240 |
| 4,219,289 | 8/1980 | Trützschler | 19/105 X |
| 4,271,565 | 6/1981 | Grunder | 19/240 |
| 4,272,868 | 6/1981 | Grunder | 19/240 |
| 4,387,486 | 6/1983 | Keller et al. | 19/105 |
| 4,393,547 | 7/1983 | Hösel | 19/300 X |
| 4,394,790 | 7/1983 | Keller et al. | 19/105 |

*Primary Examiner*—Louis K. Rimrodt

*Attorney, Agent, or Firm*—Richards, Shefte & Pinckney

[57] ABSTRACT

Method and apparatus for processing textile materials and, in particular, controlling the density of fiber in a carding system. A fiber feeder is provided which includes a blower and an oscillating plate, both of which act to compress fiber collected in the chute of the fiber feeder. A first sensing device is utilized at the discharge of the fiber feeder to sense the density of the batt being fed therefrom to a card, and a second sensing device is utilized at the trumpet of the card to sense the density of the fiber which forms the sliver in such trumpet. Control means is provided to regulate the operating speed of the blower and the oscillating plate in response to the signals generated by the first and second sensing devices.

11 Claims, 2 Drawing Figures

METHOD AND APPARATUS FOR CONTROLLING FIBER DENSITY

BACKGROUND OF THE INVENTION

In textile carding systems, the advantages of maintaining the uniformity of the sliver formed by the card, and reducing yarn count varaitions are well known. Conventional autoleveling to vary the rates of the speed of the doffer roll and the input feed roll in response to variations in the density of the sliver leaving the card is one familiar effort to improve sliver uniformity. Additionally, other efforts have been made to control the nature of the fiber batt that is fed to the card, to thereby improve the quality of end product of the card.

For example, systems are known in which the thickness of the batt formed by a fiber feeding device is sensed, and variations in the batt thickness are used to vary the speed of the discharge rolls through which the batt is fed from the fiber feeding device for delivery to the input of the card. It is also known, as disclosed in Erben U.S. Pat. No. 4,321,732, that the pressure of the collected fiber in a fiber feeding device may be used to vary the speed of inlet feed roll of such device, and, as disclosed in Krull U.S. Pat. No. 4,206,823, to sense the weight of the batt formed by a fiber feeder device and vary the speed of the discharge rolls of the fiber feeding device and the speed of the input rolls of the card. Also, in Beukent U.S. Pat. No. 3,896,523, a control system is disclosed by which the speed of the oscillation plate, or spanker plate, in the fiber feeding device is coordinated to vary proportionately to, and in dependence upon, the speed of the feeding means to the card.

In co-pending U.S. patent application Ser. No. 255,109, filed Apr. 17, 1981, now U.S. Pat. No. 4,387,486 a system is disclosed for improving silver uniformity in which the spanker plate and inlet feed roll of a fiber feeder are normally operated at speeds which are proportional to the operating speed of the card, and the weight of the batt leaving the fiber feeder is sensed to generate a signal that is utilized to override the primary drive for the spanker plate and thereby vary the ratio between the operating speed of the spanker plate and the card. Additionally, the level of collected fiber in the fiber feeder is sensed to generate a signal that is utilized to override the primary drive of the inlet feed roll of the fiber feeder.

Finally, fiber feeding devices for forming batts have heretofore been provided with air pressure generating means, such as a blower, to improve the uniformity of the batt by compressing the fiber collected in the device and/or by equalizing the level of such collected fibers as disclosed for example in Husges U.S. Pat. No. 4,135,911, Hecker U.S. Pat. No. 3,482,883, and co-pending U.S. patent application Ser. No. 340,625, filed Jan. 19, 1982, now U.S. Pat. No. 4,476,611.

Thus, in general, the prior art discussed above falls into two categories, namely changing the card speed as the sliver density changes, or regulating the operations of the fiber feeding devices as the density of the batt delivered therefom varies. In the present invention, by contrast, the uniformity of the sliver is improved by sensing the density of the sliver and the batt, and directly controlling the compressing means in the fiber feeding devices to compensate for, and correct, the sensed variations in such densities.

SUMMARY OF THE INVENTION

In accordance with the present invention, a fiber feeding device is provided which preferably includes both a pneumatic means and a mechanical means for compressing the fiber which is collected in such device, and a control system is provided by which the density of the sliver formed by the card is sensed and high and low signals are generated when the sliver density is above or below, respectively, a predetermined density level. The high signal is used to vary the operation of the pneumatic and mechanical compressing means so as to decrease the compression of the fiber collected in the fiber feeding device, and the low signal is used in a corresponding manner to increase the compression of the collected fiber.

Additionally, the control system of the present invention preferably includes means for sensing the density of the batt formed by the fiber feeding device and generating high and low signal when such batt density is above or below, respectively, a predetermined level. These high and low batt density signals are utilized in conjunction with the high and low sliver density signals to vary the compression of the collected fiber in the fiber feeding device in a predetermined manner.

In the preferred embodiment of the present invention, the mechanical compressing means is a conventional oscillating spanker plate and the pneumatic compressing means is a blower which imposes air pressure on the collected fiber in the fiber feeder, and both the spanker plate and the blower are driven by the same motor which is controlled by the aforesaid control system.

DESCRIPTION OF THE PREFERRED EMBODIMENT

Figure 1:
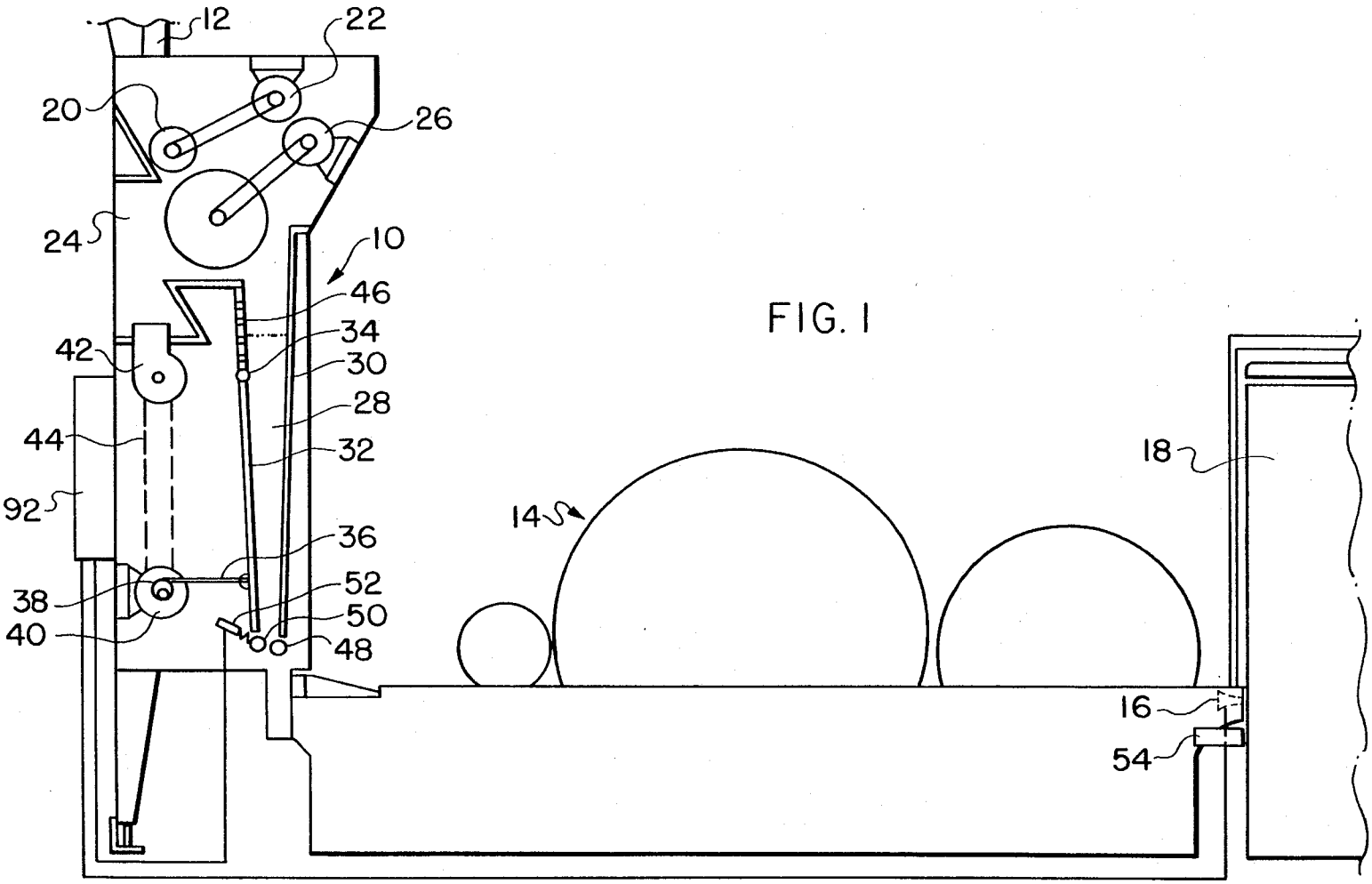
FIG. 1 is a diagrammatic view of a fiber feeding device and a carding machine in which the present invention is employed.

A textile processing system is illustrated in FIG. 1 and includes a fiber feeding device 10 which, as will be described in greater detail presently, receives loose fiber from an inlet duct 12 and forms such fiber into a batt that is fed into a carding machine 14 which, in turn, forms the fiber into a sliver that is delivered through a trumpet 16 to a coiler 18.

The fiber feeding device 10 is generally similar to the fiber feeding device disclosed in greater detail in co-pending U.S. Patent Applications Ser. Nos. 336,016, filed Dec. 30, 1981 now U.S. Pat. No. 4,394,790, and 340,635, filed Jan. 19, 1982, now U.S. Pat. No. 4,476,611, and includes an inlet feed roll 20 operated by motor 22, and an opening roll 24 operated by a motor 26. A chute 28 is provided for collecting fiber delivered thereto by the opening roll 24, the chute 28 including a fixed wall portion 30 and an opposite movable wall portion 32 that is pivoted at 34 for oscillating movement toward and away from the fixed wall portion 30 to compress or densify the collected fiber therebetween. Oscillation of the pivoted wall portion 32 is obtained by a conventional drive which includes a linkage 36 connected to an eccentric drive 38 on a variable speed electric motor 40. The fiber feeding device 10 also includes a blower 42 that is driven through a belt drive 44 from the motor 40, the blower 42 being arranged to generate a flow of air that passes upwardly from the discharged end of the blower 42, around the upper portion of the opening roll 24, and downwardly therefrom the chute 28 where the air passes through a perforated plate 46 located above the oscillating wall portion 32, all as explained in greater detail in the aforesaid co-pending patent applications. This flow of pressurized air, in addition to equalizing the level of the fiber collected in the chute 28, tends to compress or densify such collected fiber by imposing air pressure at the upper surface thereof. Thus, it will be noted that compression of the collected fiber in the chute 28 is obtained from both the blower 42 and the oscillating wall portion 32, both of which are driven by the same motor 40, so that if the speed of the motor 40 is increased, the air pressure produced by the blower 42 and the rate of movement of the oscillating wall portion 32 are both increased to increase the compressive force imposed on the collected fiber in the chute 28. Similarly, decreasing the speed of the motor 40 will act to decrease the compressive force imposed on such collected fiber by the blower 42 and the oscillating wall 32.

A pair of discharge rolls 48 and 50 are disposed at the bottom or discharge end of the chute 28 for delivering therethrough a batt of fiber that is fed to the inlet end of the carding machine 14. One of these rolls, 48, is fixed, and the other, 50, is arranged in any conventional and well known manner for linear movement toward and away from the fixed roll 48 in response to variations in the thickness of the batt passing therethrough. Thus, the linear displacement of the movable roll 50 is a function of the thickness of the batt being discharged from the fiber feeding device 10, and, therefore, a function of the density of the batt. As shown diagrammatically in FIG. 1, a conventional linear displacement transducer 52 is associated with the movable roll 50 for generating electrical signals indicating whether the thickness of the butt is above or below a predetermined level for a purpose to be explained in greater detail presently. The displacement transducer 52 may be initially located with respect to the movable roll 50 so that no signal will be generated with the batt size is to desired thickness, and so that variations of the batt size above and below such desired thickness will cause the displacement transducer to generate different voltage signals, respectively, which are proportionate to the batt thickness variance from the desired thickness.

Figure 2:
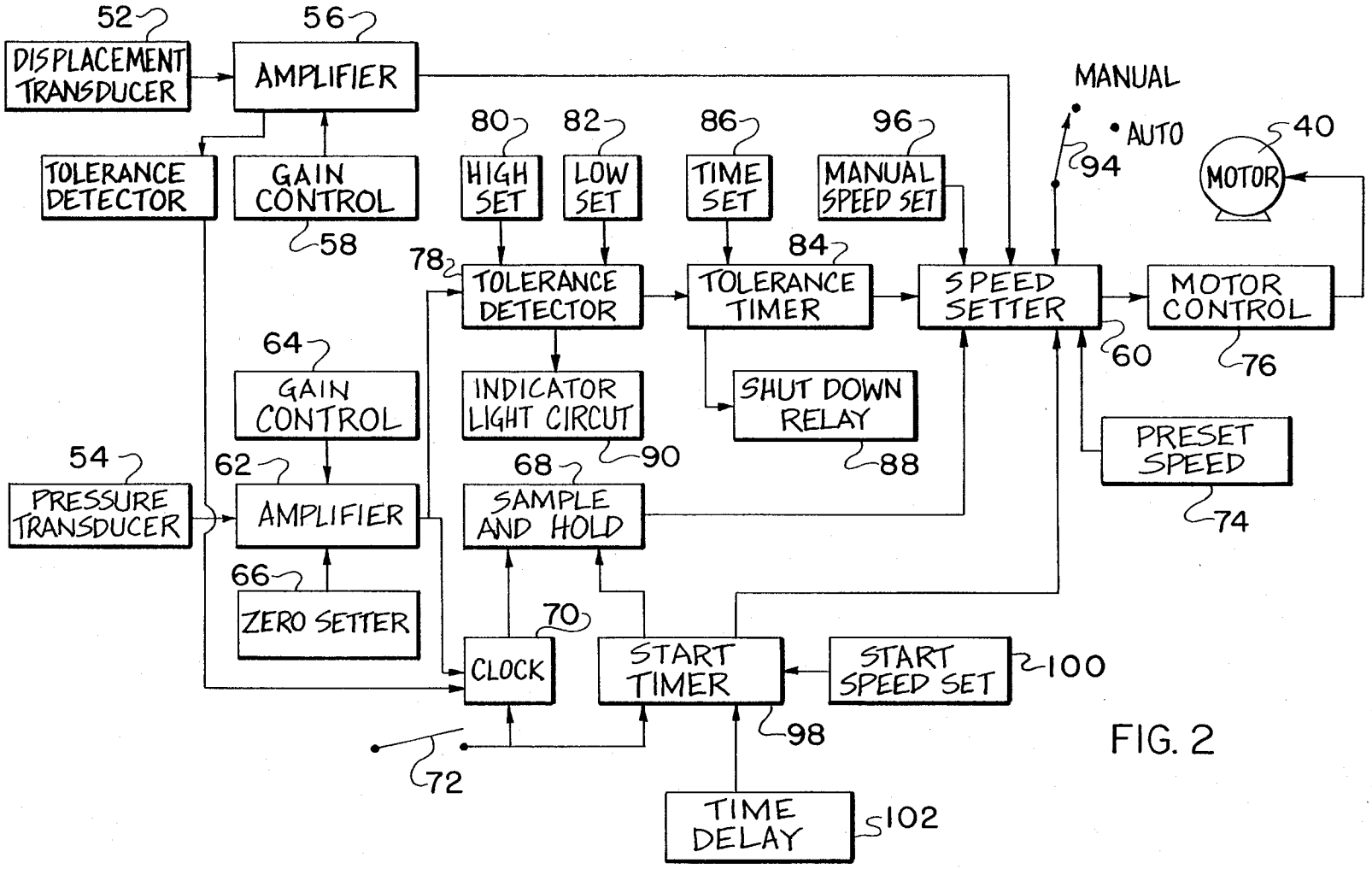
FIG. 2 is a diagrammatic illustration of the control circuit for the present invention.

As noted above, the carding machine 14 includes a conventional trumpet 16 through which fiber that has been processed by the carding machine 14 is passed and formed into a sliver. A conventional differential air pressure transducer 54 is associated with the trumpet 16 which uses a controlled air flow and pressure differential sensing means to generate voltage signals indicating whether the size of the sliver is above or below a predetermined level, and the extent of such variance. The signals generated by the displacement transducer 52 and the pressure differential transducer 54 are indicative of the density of the batt and the sliver, respectively, and these signals are utilized in the present invention to vary the compression imposed on the collected fiber in the chute 28. FIG. 2 illustrates diagrammatically a typical electrical control circuit that is suitable for carrying out the control features of the present invention.

The control circuit includes the aforesaid displacement transducer 52 which generates a voltage signal that is indicative of the density of the batt passing between the rolls 46,48, and this voltage signal is fed to an amplifier 56 having a gain control 58 which can be set to vary the amplification of the voltage signal to any desired level, such amplified signal then being transmitted to the speed setter circuit 60.

The control circuit also includes the aforementioned differential pressure transducer 54 at the trumpet 16 which generates a voltage signal indicative of the density of the fiber passing through the trumpet 16, and this voltage signal is fed to an amplifier 62 having a gain control 64 which can be used to set the amplification of the signal to any desired level. A zero setter circuit 66 is also provided for the amplifier 62 to establish a selected voltage level representing the desired density of fiber passing through the trumpet 16, whereby if the voltage signal generated by the pressure transducer 54 is less than the selected voltage it will indicate the extent to which the fiber density is too light, and if such voltage signal is greater than the selected voltage it will indicate the extent to which the fiber density is too heavy.

The amplifier signal from amplifier 62 is then transmitted to a clock circuit 70 that is energized when the card 14 is started by start switch 72. The clock circuit 70 is designed to accept or "read" the voltage signal from the amplifier 62 at predetermined timed intervals (e.g. 10 seconds) and to transmit such signal to a sample and hold circuit 68 which, during such timed interval, transmits the sensed signal as a constant to the speed setter circuit 60, regardless of fluctuations in the voltage signal transmitted from the amplifier 62 during such timed interval. While it would be possible, if desired, to transmit the amplified signal directly from the amplifier 62 to the speed setter circuit 60, it is preferred to use the sample and hold circuit 68 and the clock circuit 70 to avoid constant, albeit usually small, variations in the signal that is transmitted to the speed setter circuit 60. The speed setter circuit 60 also receives an input signal from a preset speed circuit 74 which can be selectively set manually and which establishes a preset or uncorrected base speed for the motor 40.

The speed setter circuit 60 is designed so that if there are no correcting signals received from the circuits of either the differential pressuer transducer 54 or the displacement transducer 52, the signal from the preset speed circuit 74 is transmitted to the motor control circuit 76 which, in turn, operates the motor 40 at the aforesaid preset or base speed level. If, however, correcting signals are received from either the differential pressure transducer 54 or the displacement transducer 52, or from both, the speed setter circuit 60 will adjust the signal transmitted to the motor control circuit 76 to thereby vary the speed of the motor 40. The extent of this adjustment is determined by the design of the speed circuit 60, and if such circuit is receiving correcting signals from both transducers 52,54, it can be designed to vary the adjustment of the signal from the preset speed circuit 74 by an amount that is proportional to the difference between the correcting signals from the transducers 52,54. It will be noted, in this regard, that since both the amplifiers 56 and 62 include selectively settable gain control circuits 58 and 64, respectively, as described above, the level of the two voltage signals from the transducers 52,54, can be individually increased or decreased to thereby vary the proportionate corrective effectiveness of such signals when they are received by the speed setter circuit 60.

Thus, in some applications of the present invention, e.g. when processing synthetic fibers, it is generally more important to use the density of the fiber at the trumpet as the primary connecting signal, and in such applications the gain control 62 for the pressure transducer 54 would be increased so that it would have a proportionately greater correcting effect on the speed setter circuit 60. Similarly, when cotton fiber is being processed, it is usually preferably for the density of the batt leaving the chute 28 to have the primary correcting effect, and the gain control 64 would therefore usually be set at a relatively high level, In any event, it will be appreciated that the signals from both transducers 52,54 can be used simultaneously to vary the speed of the motor 40 to thereby vary the speed of operation of both the blower 42 and the oscillating wall 32, and the proportional corrective effectiveness of the two transducers 52,54 can be selectively varied.

The control circuit also includes a tolerance detector circuit 78 that receives the amplified signal from the amplifier 62, and that includes a high set input 80 and a low set input 82 which can be selectively adjusted to establish predetermined maximum and minimum voltage values for the tolerance detector circuit 78, the predetermined voltage range between such maximum and minimum values being the normal tolerance range for the varying voltage signals produced by the pressure transducer 54 and amplifier 62. If the voltage signal received by the tolerance detector circuit 78 is beyond this predetermined range, a signal indicating such abnormality is transmitted from the tolerance detector circuit 78 to the tolerance timer circuit 84 which has an input from a time set circuit 86. If the abnormal signal received by the tolerance timer circuit 84 continues for a determined time period, which may be selectively set by manually adjusting the time set circuit 86, a signal is transmitted to the speed setter circuit 60 which, upon receipt of such signal, will cause the motor control circuit 76 to operate the motor 40 at a predetermined maximum or minimum speed (depending upon whether the abnormal signal is above or below the predetermined range), regardless of how long the abnormal signal continues and regardless of how much variance there is between the abnormal signal and the normal range for such signals. Thus, for example, even if the density of the fiber at the trumpet 16 should reach a predetermined abnormally high level and remain there beyond a predetermined time interval, the operating speed of the shaker wall 32 and the blower 42 will not be permitted to exceed a predetermined maximum level after the abnormal signal is received. As a further safeguard, the tolerance timer circuit 84 also transmits a signal to a card shut down relay 88 to stop the operation of the card 14 when the aforesaid abnormal conditions exist. Finally, the tolerance detector circuit 78 generates signals which are transmitted to an indicator light circuit 90 which will usually include a plurality of indicator lamps (not shown) on the control panel 92 which, when lit, indicate varying conditions of the density of the fiber at the trumpet, such as indicating when the fiber density is at its predetermined desired level or above or below such level, and indicating when such density is abnormally high or low.

A "manual/auto" switch 94 is provided so that the speed setter circuit 60 can be selectively operated in an automatic mode in which the speed of the motor 40 is automatically controlled in response to signals from the transducers 52,54 as described above, or in a manual mode in which the speed of the motor 40 is operated at a preselected set speed that can be selected and set by the manual speed set circuit 96.

As is well known in the art, the initial start up of a card involves bringing the card up to perating speed slowly, and usually in progressive steps. The control circuit of the present invention includes a feature by which, at start up of the card 14, the motor 40 is automatically operated at a preset, generally low, speed for a predetermined time interval. Thus, the initial closing of the aforesaid start switch 72 energizes a start time circuit 98 having an input from a start speed set circuit 100 that can set the preset speed of the motor 40 at any desired level and having an input from a time delay circuit 102 that can be set to determine the time period at which the motor 40 will be operated at its preset speed. Upon closing the start switch 72, the start timer circuit 98 will transmit a signal to the speed setter circuit 60 which will operate the motor at the preset speed for a predetermined time interval during start up of the card 14. Additionally, the start timer circuit 98 may also transmit a signal to the aforementioned sample and hold circuit 68 to reset the latter by removing any prior conditioning established during a prior operating cycle of the card 14.

Finally, the control circuit of the present invention may include a further tolerance detector circuit 104 which receives voltage signals from the amplifier 56, and which is designed to sense when such signals are above or below predetermined levels that can be preset in the circuit or can be adjustably set by high set and low set circuits (not shown) similar to the above-described high and low set circuits 80,82. When the tolerance detector circuit 104 senses that the signal from amplifier 56 is above or below the predetermined levels, it will transmit a signal to the above-described clock circuit 70. The clock circuit 70 is designed such that if the signal received from the tolerance detector circuit 104 is opposite to the signal being received from the amplifier 62, e.g. the emplifier 62 signal indicates the sliver density is too heavy whereas the signal from the tolerance detector circuit 104 is too light, then the clock circuit 70 will not transmit any signal at all to the sample and hold circuit 68, whereby no correcting signal from the sliver pressure transducer 54 is transmitted to the speed setter circuit 60 and it will control the motor 40 only in response to correcting signals generated by the displacement transducer 54. By utilizing this feature of the control circuit, in the unusual circumstance when the two transducers 52,54 are indicating opposite predetermined density conditions of the sliver and the batt, the control circuit will respond only to correcting signals from the displacement transducer 52 because it is usually preferable to make density corrections based on variations of the density of the batt before it has reached the card 14 rather than relying upon the opposite sensed sliver density as it leaves the card.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

We claim:

1. Apparatus for processing textile materials, including:

(a) fiber feeding means for receiving fiber and forming said fiber into a batt, said fiber feeding means including chute means for collecting said fiber, selectively variable pneumatic means for exerting a pneumatic compressing force on said collected fiber in said chute means, and selectively variable mechanical means for mechanically compressing said collected fiber in said chute means;

(b) carding means receiving said batt of fiber from said fiber feeding means and forming said fiber into a sliver; and (c) regulating means including:

(i) first signaling means for sensing the density of said sliver and for generating high and low signals indicating, respectively, that said sliver density is above or below a predetermined level; and (ii) control means for receiving said generated signals and for varying the operation of said pneumatic means and said mechanical means to decrease the compression of said collected fiber in said chute means upon receipt of said high signal and to increase the compression of said collected fiber upon receipt of said low signal.

2. Apparatus for processing textile materials as defined in claim 1 and further characterized in that said fiber feeding means includes a motor for simultaneously and directly driving said pneumatic means and said mechanical means, and in that said control means regulates the speed of said motor to thereby vary said operation of said pneumatic means and said mechanical means.

3. Apparatus for processing textile materials as defined in claim 1 and further characterized in that said mechanical means includes an oscillating wall portion movable toward and away from a fixed wall portion of said chute means to compress fiber located therebetween, and in that said pneumatic means is a blower for generating air pressure to compress said collected fiber.

4. Apparatus for processing textile materials as defined in claim 1 and further characterized in that second signaling means is provided for sensing the density of said batt formed by said fiber feeding means and for generating high and low signals indicating, respectively, that the density of said batt is above or below a predetermined level, and in that said control means varies said operation of said pneumatic means and said mechanical means in a predetermined manner in response to said signals from both said first and second signaling means.

5. Apparatus for processing textile materials as defined in claim 4 and further characterized in that said control means varies said operation of said pneumatic means and said mechanical means to decrease the compression of said collected fiber upon receipt of said high signals from both said first and second signaling means.

6. Apparatus for processing textile materials as defined in claim 4 and further characterized in that said control means varies said operation of said pneumatic means and said mechanical means to increase the compression of said collected fiber upon receipt of said low signals from both said first and second signaling means.

7. Apparatus for processing fiber material, including:

(a) fiber feeding means for receiving fiber and forming said fiber into a batt including chute means for collecting said fiber and having a fixed wall portion and an opposite oscillating wall portion movable toward and away from said fixed wall to compress said collected fiber, a blower for generating air pressure which acts to compress said collected fiber, and a variable speed motor having a direct drive to said oscillating wall portion and to said blower;

(b) carding means receiving said batt of fiber from said fiber feeding means and forming said fiber into a sliver; and (c) regulating means including:

(i) first signaling means for sensing the density of said sliver and for generating high and low signals indicating, respectively, that said sliver density is above or below a predetermined level;

(ii) second signaling means for sensing the density of said batt and for generating high and low signals indicating, respectively, that said batt density is above or below a predetermined level; and (iii) control means receiving said generated signals from said first and second signaling means and being operatively connected to said variable speed motor, said control means acting to decrease the speed of said motor upon receipt of said high signals from both said first and second signaling means, and to increase the speed of said motor upon receipt of said low signals from both said first and second signaling means.

8. Apparatus for processing textile materials, including:

(a) fiber feeding means for receiving fiber and forming said fiber into a batt, and including chute means for collecting said fiber and variable speed compressing means for compressing said collected fiber;

(b) carding means for receiving said batt of fiber from said fiber feeding means and forming said fiber into a sliver; and (c) regulating means including:

(i) first signaling means for sensing the density of said sliver and for generating high and low signals indicating, respectively, that said sliver density is above or below a predetermined level;

(ii) second signaling means for sensing the density of said batt and for generating high and low signals indicating, respectively, that said batt density is above or below a predetermined level; and (iii) control means receiving said generated signals from said first and second signaling means and being operatively connected to said variable speed compressing means to increase or decrease the speed thereof and thereby increase or decrease the compression of said collected fiber in response to said receipt of said generated signals.

9. A method of processing textile materials through apparatus including a fiber feeder having air pressure means and mechanical means for compressing collected fiber in the fiber feeder, and including a carding means for receiving a batt of fiber material from said fiber feeder and forming said fiber into a sliver, said method comprising the steps of:

(a) sensing the density of said sliver and generating high and low signals when said sliver density is above or below, respectively, predetermined limits;

(b) utilizing said high signal to vary the operation of said air pressure means and said mechanical means to automatically decrease the compression of said collected fiber in said fiber feeder; and (c) utilizing said low signal to vary the operation of said air pressure means and said mechanical means to automatically increase the compression of said collected fiber in said fiber feeder.

10. A method of processing textile fibers as defined in claim 9 and further characterized by the steps of sensing the density of said batt and generating high and low signals when said batt density is above or below, respectively, predetermined limits, and varying said operation of said air pressure means and said mechanical means to automatically decrease the compression of said collected fiber when said high sliver density signal and said high batt density signals have been generated.

11. A method of processing textile fibers as defined in claim 9 and further characterized by the steps of sensing the density of said batt and generating high and low signals when said batt density is above or below, respectively, predetermined limits, and varying said operation of said air pressure means and said mechanical means to automatically increase the compression of said collected fiber when said low sliver density signal and said low batt density signals have been generated.

* * * * *